US006022270A

United States Patent [19]

Bascaran et al.

[11] Patent Number: 6,022,270

[45] Date of Patent: Feb. 8, 2000

[54] AIR CONDITIONER FRONT GRILLE WITH INSERTS FOR BRAND DIFFERENTIATION

[75] Inventors: Eduardo Bascaran; Victoriano Zamora, both of Nuevo Leon; Nestor Hernandez, Mirador Residencial Monterrey; Jose Oliva; David Hernandez, both of Nuevo Leon, all of Mexico

[73] Assignee: Carrier Corporation, Syracuae, N.Y.

[21] Appl. No.: 09/139,903

[22] Filed: Aug. 26, 1998

[51] Int. Cl.[7] ..... E06B 7/02

[52] U.S. Cl. ..... 454/201; 62/262; 312/101; D23/354

[58] Field of Search ..... 62/262; D23/351, D23/353, 354; 312/101; 454/201

[56] References Cited

U.S. PATENT DOCUMENTS 3,766,749 10/1973 Livesay ..... 62/262
4,559,868 12/1985 Nonanka et al. .
5,038,577 8/1991 Stanford ..... 62/262
5,125,239 6/1992 Kobayashi et al. ..... 62/262

*Primary Examiner*—Harold Joyce

[57] ABSTRACT

A front grille for a room air conditioning unit includes a planar front section, which includes an air inlet opening, an air outlet opening, and an opening configured to receive the unit's control panel when mounted on an air conditioning unit. The front section has a top wall, bottom wall, and left and right-hand side walls, each of which extend rearwardly of the front section and cooperate with one another to define a skirt element integrally formed with and extending rearwardly from the planar front section. An elongated recess is formed in the planar front section. One or more inserts, each of which is configured to be received in the recess in the front section, are provided. Each of the inserts has a distinguishing ornamental configuration thereon, which is different from the distinguishing ornamental configuration of the other inserts. Means are provided in the elongated recess and on each of the inserts for cooperating with one another to retain each of the inserts in the recess.

5 Claims, 6 Drawing Sheets

AIR CONDITIONER FRONT GRILLE WITH INSERTS FOR BRAND DIFFERENTIATION

BACKGROUND OF THE INVENTION

The present invention is directed to air conditioners and, more particularly, to the configuration of the indoor grill of a room air conditioner.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The indoor grille also includes a region therein wherein the control panel for the air conditioner unit is located.

The location of the various openings in a front grille are dictated by the location of the components of the particular air conditioner on which the grille is adapted to be used. For a given air conditioning unit having an evaporator, air discharge, and control panel located in a given position, the grille adapted to be used with that unit must have the appropriate openings arranged to cooperate with such components when the grille is installed on the unit.

When a room air conditioner is installed in a window or a wall opening, the front grille is normally the only part of the air conditioner which is visible to the consumer. Accordingly, the appearance of the front grille, once the unit is installed, is the only appearance feature distinguishing one air conditioning unit from another. It is common practice for a basic air conditioning unit to be marketed under more than one brand name. Accordingly, in order to distinguish one brand from another when using the same basic unit, it is necessary to have an indoor grille which is sufficiently different in appearance to distinguish one brand from another. Usually, this requires a grille having the same basic openings as described above but with a different ornamental appearance. Typically, such grilles are fabricated from a molded plastic material and thus require a fairly large mold. When two or more different brands are desired for the same basic unit, the expense of such additional molds becomes a significant cost consideration. It is accordingly desirable to be able to fabricate indoor grilles which have distinguishing characteristics for brand differentiation without incurring the high costs of acquiring a number of large molds.

SUMMARY OF THE INVENTION

A front grille for a room air conditioning unit includes a planar front section, which includes an air inlet opening, an air outlet opening, and an opening configured to receive the unit's control panel when mounted on an air conditioning unit. The front section has a top wall, bottom wall, and left and right-hand side walls, each of which extend rearwardly of the front section and cooperate with one another to define a skirt element integrally formed with and extending rearwardly from the planar front section. An elongated recess is formed in the planar front section. One or more inserts, each of which is configured to be received in the recess in the front section, are provided. Each of the inserts has a distinguishing ornamental configuration thereon, which is different from the distinguishing ornamental configuration of the other inserts. Means are provided in the elongated recess and on each of the inserts for cooperating with one another to retain each of the inserts in the recess.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
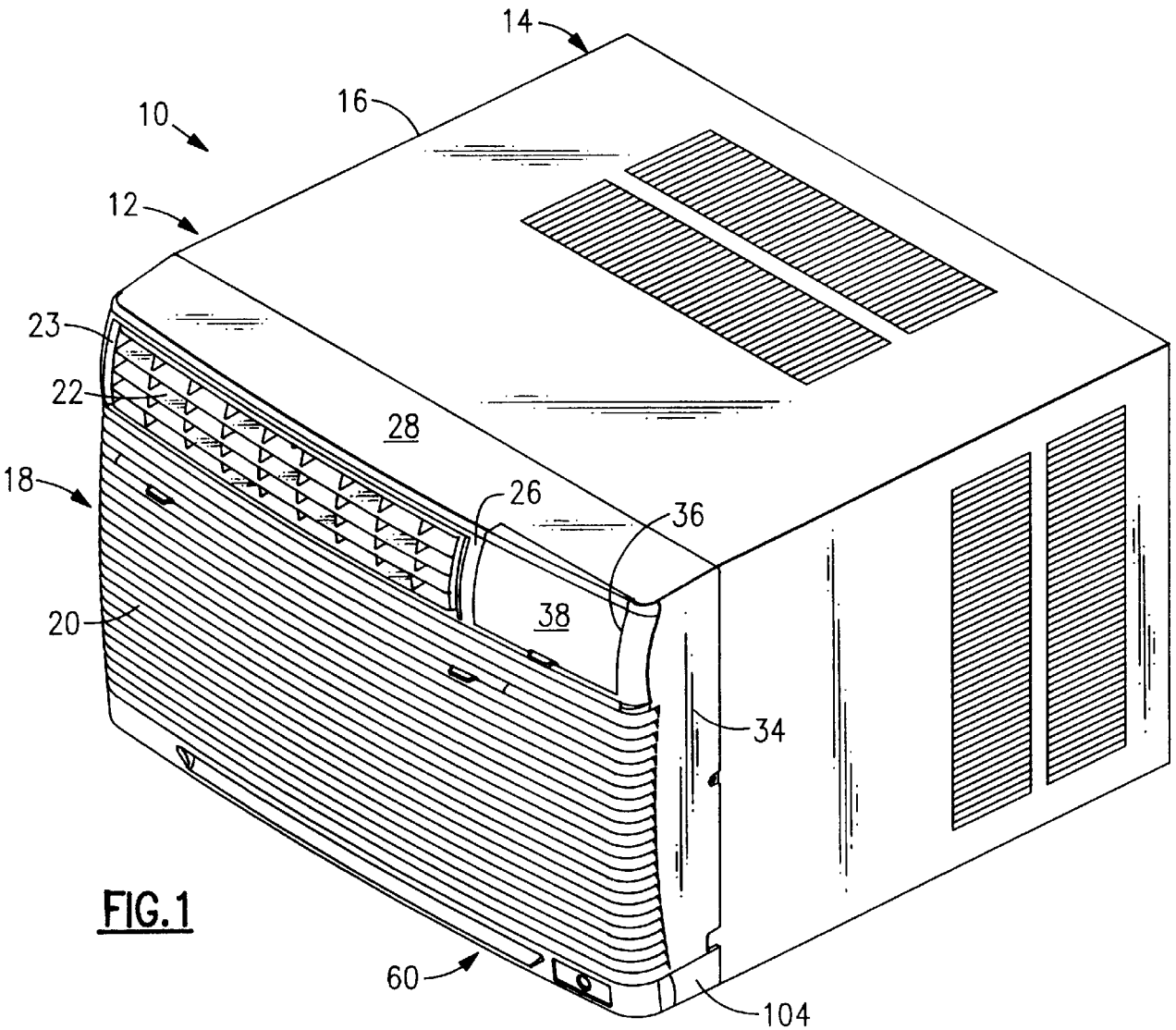
FIG. 1 is a perspective view of a room air conditioner, which embodies the features of this invention.

FIG. 1 illustrates an air conditioner unit 10 which includes generally an indoor section 12 and an outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional.

The indoor section 12 includes an indoor grille section 18, which includes inlet louvers 20 and an air discharge assembly 22 mounted in an air discharge opening 23. During operation of the air conditioner, air from the space to be conditioned is drawn by action of an evaporator fan (not shown) through the inlet louvers 20 and is directed through an evaporator coil (not shown) where the air is cooled. The cooled air is then directed back into the room to be cooled through the air discharge opening 23 and air discharge assembly 22.

Figure 2:
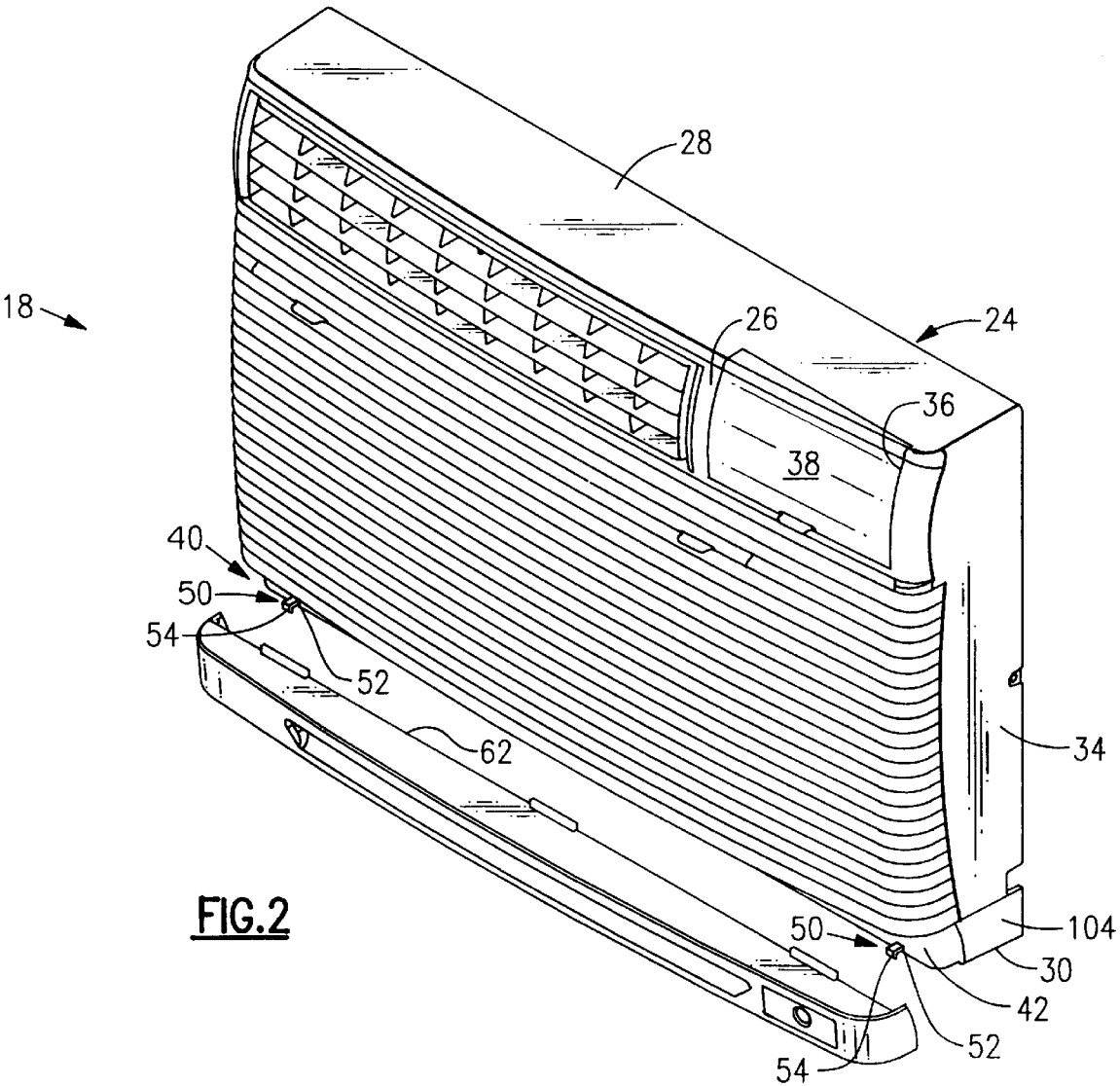
FIG. 2 is a partially exploded view of the front grille of the air conditioner illustrated in FIG. 1.
Figure 4:
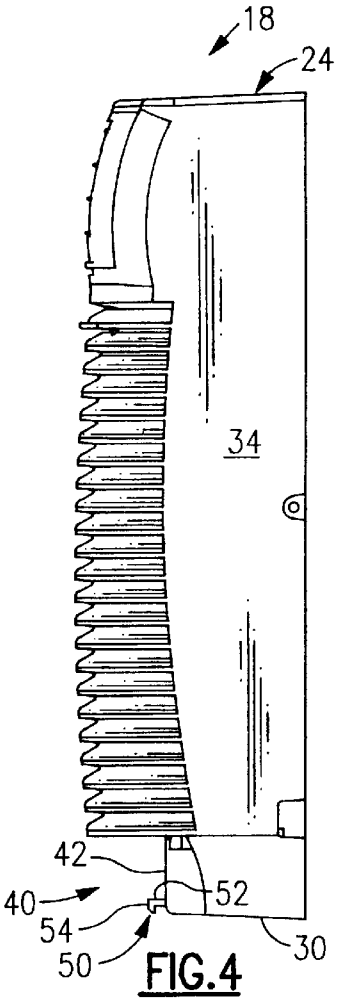
FIG. 4 is a right-hand side view of the grille of FIG. 3.
Figure 6:
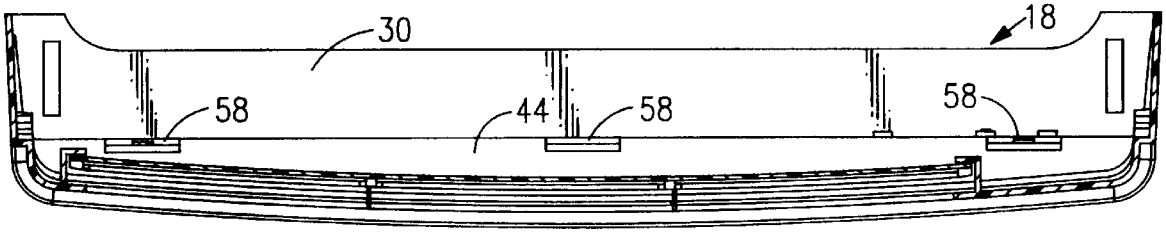
FIG. 6 is a view taken along the line 6—6 of FIG. 5.

With reference now particularly to FIGS. 2–6, the indoor grille 18 comprises a large molded plastic frame-like component 24 in which the inlet louvers 20 and the opening 23 for the air discharge assembly 22 are formed. The grille frame 24 comprises a substantially planar front section 26, a top wall 28, a bottom wall 30, and left and right-hand side walls 32 and 34, respectively. As best seen in FIGS. 2, 4 and 6, the top, bottom and side walls each extend rearwardly of the front section 26 and cooperate with one another to define a skirt-like configuration integrally formed with and extending rearwardly from the front wall 26. Located in the upper right-hand corner of the front wall 26 is a rectangular opening 36, which is adapted to receive the control panel of the air conditioning unit therein. In the illustrated embodiment, the control panel opening 36 is closed by a door 38.

Figure 3:
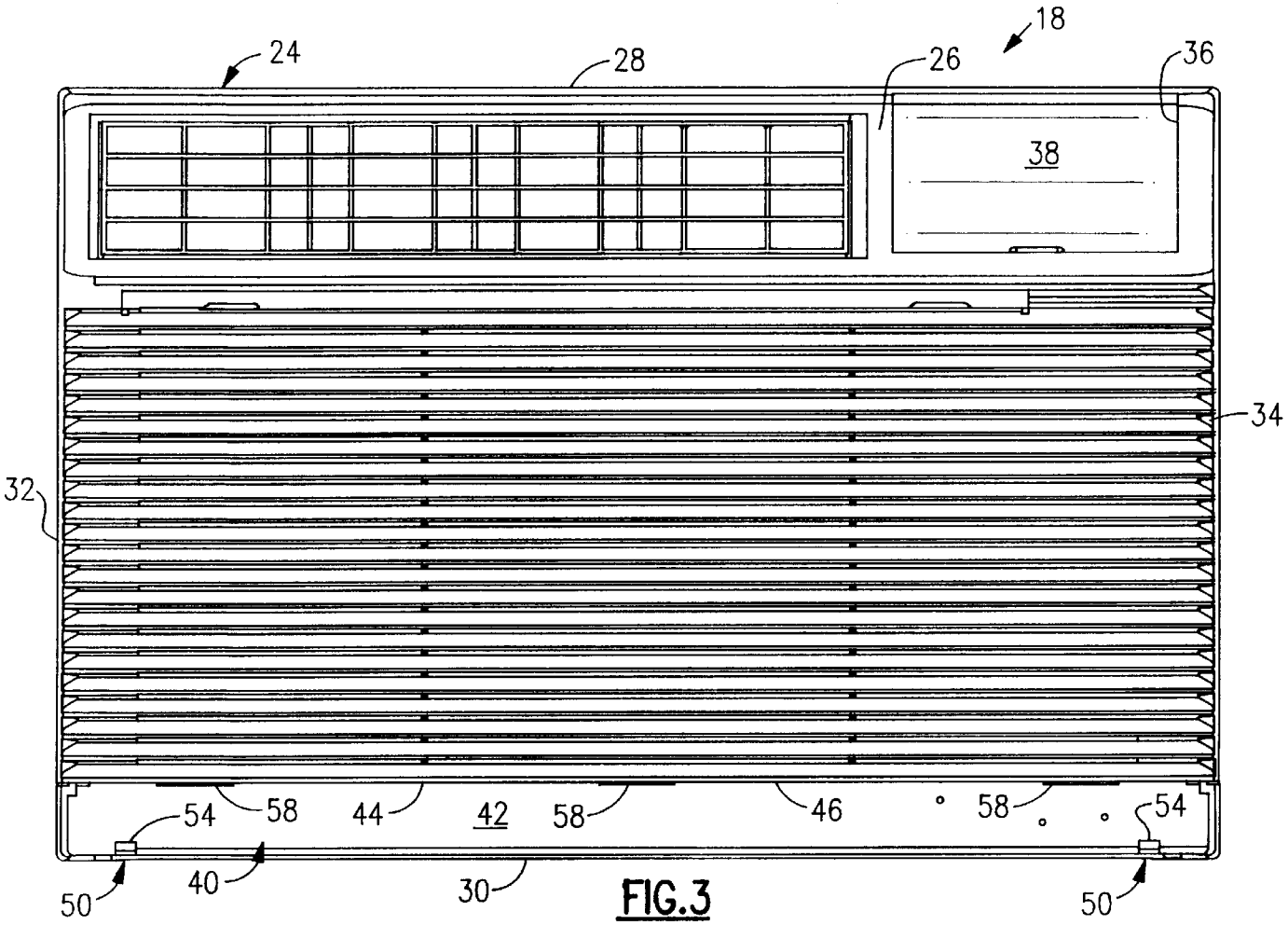
FIG. 3 is a front planar view of the grille with the ornamental insert removed therefrom.

As best shown in FIGS. 3 and 4, an elongated inverted L-shaped recess 40 is formed in the front wall 26 and bottom wall 30 of the grille frame 24. The recess 40 includes an elongated front or forwardly facing wall 42, which lies in a plane substantially parallel to the planar front wall 26 and which is spaced rearwardly therefrom, as best seen in FIG. 4. The recess further includes a top wall 44, which extends outwardly from the top edge 46 of the notch front wall 42 in substantially perpendicular relationship thereto. As is evident from the drawing figures, the recess 40 occupies the entire lower region of the grille frame 24 directly underlying the inlet louvers 20.

According to the present invention, ornamental inserts are provided which are configured to be received in the inverted L-shaped recess 40. Each of the inserts is provided with a distinguishing ornamental configuration thereon, which is different from the distinguishing ornamental configuration of any other inserts. As a result, the overall appearance of the indoor grille 18 may be substantially changed depending upon the insert which is assembled to the grille in the recess 40.

Looking now at FIGS. 3 and 4, extending outwardly from the lower edge 48 of the front wall 42 of the recess 40 are a pair of latch elements 50. Each of the latches 50 comprises a first section 52 integrally formed with the front wall 42 and extending perpendicularly thereto, and a latching head 54 formed at the outer end of the first section and extending downwardly therefrom. A forwardly facing beveled edge 56 is provided at the outer end of each of the latch heads 54.

Figure 8:
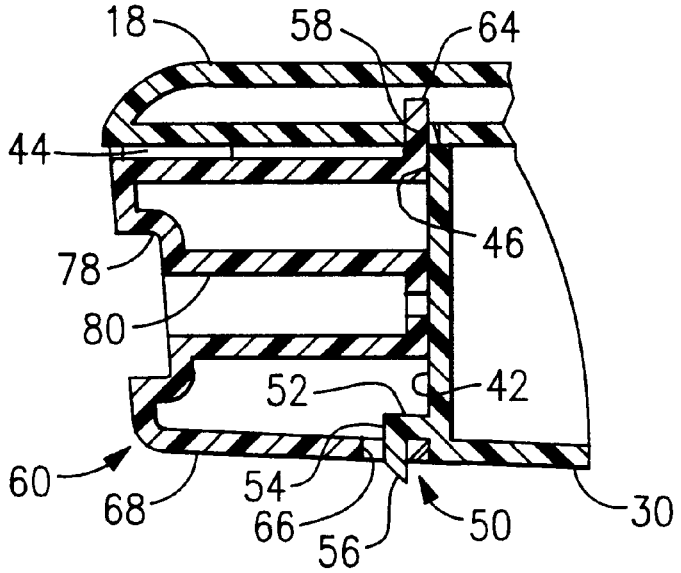
FIG. 8 is a view taken along the line 8—8 of FIG. 7.

As best seen in FIGS. 3 and 6, three elongated openings 58 are provided in the top wall 44 of the recess at the rear end thereof adjacent the intersection with the top edge 46 of the front wall 42. The openings are equally spaced along the width of the recess 40. FIGS. 9–14 illustrate three different inserts 60, which are adapted to be rigidly attached to the grille frame 24 in the recess 40. As will be described in more detail below, each of the inserts illustrated in these figures has a front, bottom and side appearance, which is substantially different from the other inserts and which provides a distinguishing ornamental configuration to the lower end of the indoor grille 18 when each is installed thereupon. A common feature to each of the inserts 60, however, is the mating structure which is adapted to engage the latches 50 and the elongated openings 58 provided in the recess 40. Each of the inserts 50 comprises a top rear edge 62, which is provided with three upwardly extending elongated latching conformations 64 thereon, which are adapted to be received in the three elongated openings 58 provided in the top wall 44 of the notch. Also common to each of the inserts 60 are a pair of openings 66 formed in the bottom wall 68 thereof, which are adapted to receive in positive latching engagement therewith the pair of latches 50 carried by the front wall 42 of the recess 40. FIG. 8 illustrates an insert 60 positively secured in the recess area by engagement of the mating latching mechanisms described above.

Figure 10:
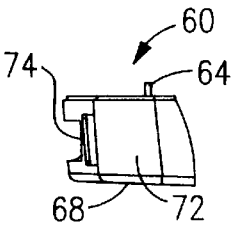
FIG. 10 is a right-hand side view of the insert of FIG. 9.
Figure 9:
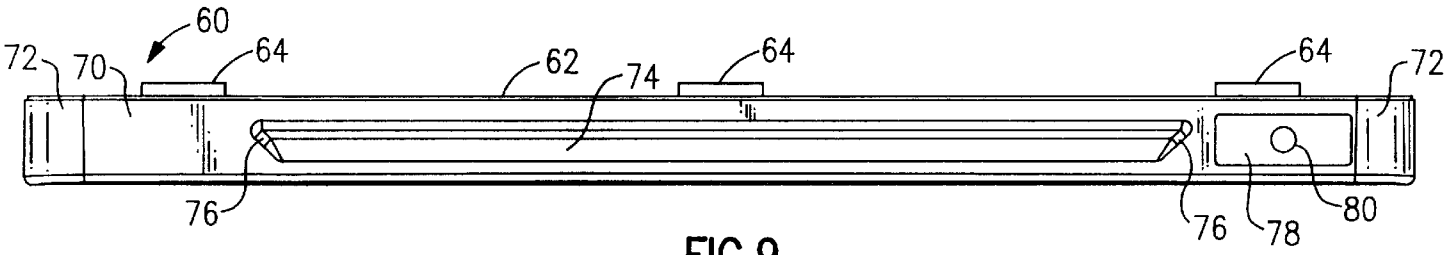
FIG. 9 is an enlarged front view of one of the ornamental inserts according to the present invention.

The insert illustrated in FIGS. 9 and 10 is shown attached to the air conditioning unit 10 in FIG. 1 and also is illustrated in the exploded view shown in FIG. 2. It will be appreciated that the FIG. 9 insert 60 comprises a front wall 70 defining a gradual arc and which terminates in inwardly curved surfaces 72 at the left and right-hand ends thereof. Further, the surface 70 is provided with an elongated recess 74 terminating in angularly arranged end sections 76. Provided on the right-hand end of the front surface 70 is a rectangular recess 78 having a circular opening 80 centrally located therein. The recess 78 and opening 80 are adapted to receive a brand name insert (not shown) therein.

Figure 5:
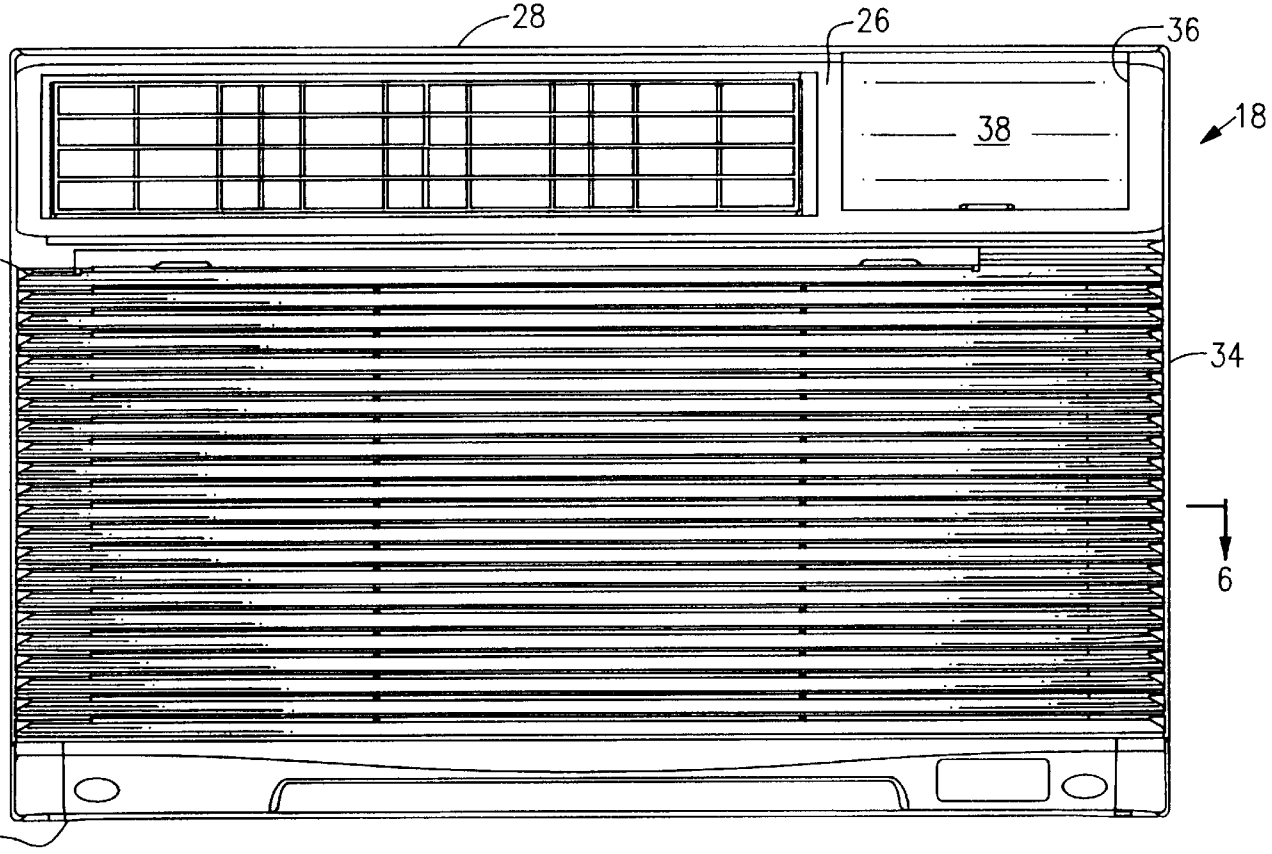
FIG. 5 is a view similar to FIG. 3 with an ornamental insert assembled to the grille.
Figure 7:
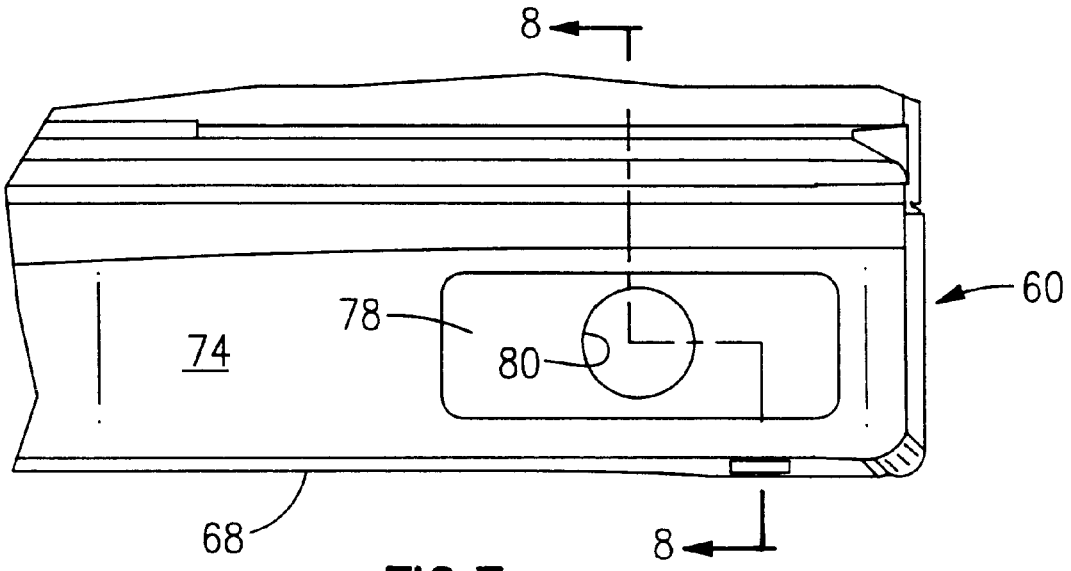
FIG. 7 is an enlarged plan view of the lower right-hand corner of the grille and ornamental insert of the unit, as illustrated in FIG. 1.
Figure 12:
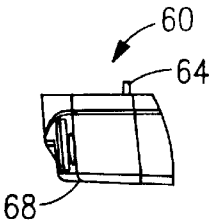
FIG. 12 is a right-hand end view of the insert of FIG. 11.
Figure 11:
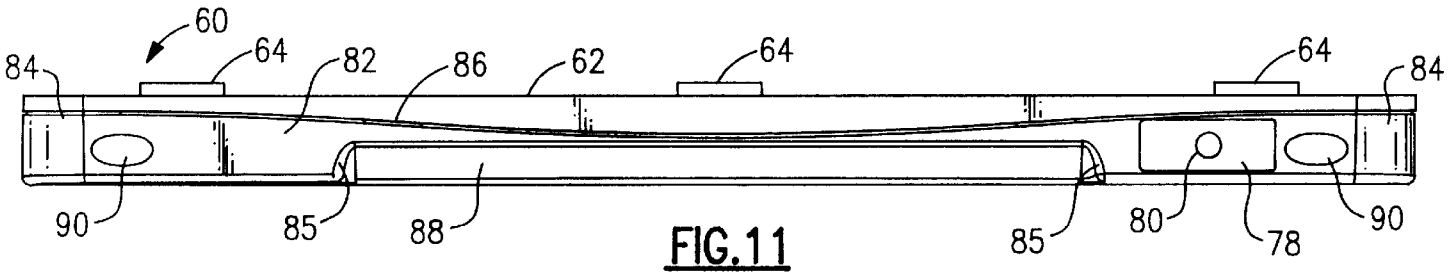
FIG. 11 is an enlarged of another ornamental insert according to the present invention.

The insert 60 illustrated in FIGS. 11 and 12 is illustrated attached to the grille frame 24 in FIG. 5. The FIG. 11 insert also includes a front surface 82, which terminates in rearwardly curved ends 84. The front wall 82 is provided with a groove 86, which extends from one end to the other curving from a high elevation at one end thereof downwardly in the center and upwardly from the other end thereof. Centrally located in the front wall 82 is a downwardly beveled surface 88, which has downwardly turned edges 85 at the ends thereof. As with the insert of FIG. 9, the FIG. 11 insert is provided with a recess 78 and opening 80 for receiving a brand name insert. Finally, the front surface 82 is provided with a pair of oval-shaped recesses 90 at the opposite ends thereof.

Figure 14:
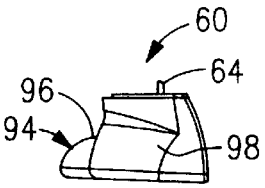
FIG. 14 is a right-hand end view of the insert of FIG. 13.
Figure 13:
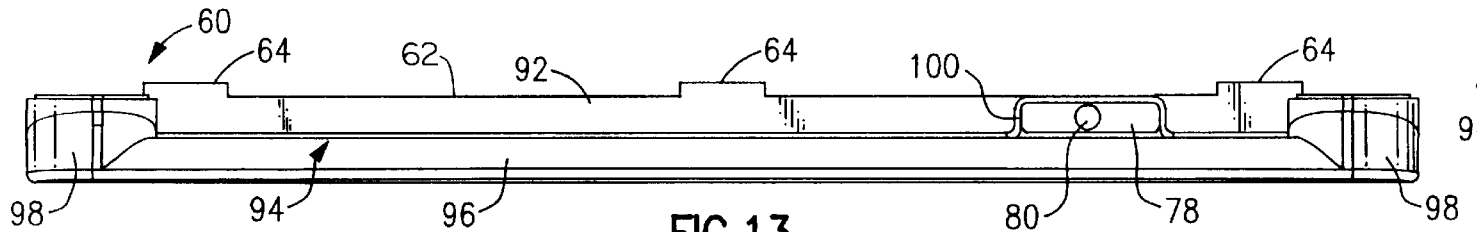
FIG. 13 is an enlarged front view of yet another ornamental insert according to the invention.

The insert 60 of FIGS. 13 and 14 includes a thin rearwardly disposed forwardly spacing wall section 92, which is no thicker than the thickness of the three latches 64 formed thereon and which has an outwardly extending curved shelf-like structure 94 formed therein. The structure 94 extends outwardly and defines a curved front edge 96. The insert includes a pair of vertically extending semi-curved sections 98 formed at the opposite ends of the front wall 92 and shelf section 94. The recess 78 and opening 80 for the brand differentiating insert are carried in a rectangular housing 100, which sits on top of the shelf 94 and which extends forwardly from the wall section 92.

It should be appreciated that each of the above described inserts has a curved right and left-hand end section which has a contour, which is adapted to match a mating contour 104 provided on the left and right-hand ends of the left and right side walls 32 and 34 of the grille frame 24. As a result, regardless of which insert is installed in the grille frame a smooth transition is provided between the curved ends of the inserts and the side walls of the grille frame.

It should be appreciated that other grille insert configurations could be made, which would provide different distinguishing ornamental configurations. The only requirement being that the common latching structure be capable of allowing rigid attachment of the insert to the grille. It will further be appreciated that as a result, a plurality of indoor grilles having distinguishing ornamental appearance may be made making use of a single mold for making the grille frame component 24 and additional smaller molds for making each of the inserts 60. As a result, considerable savings and expense for capital equipment may be realized while having a plurality of ornamentally distinguishable front grilles.

What is claimed is:

1. A front grill for a room air conditioning unit of the type including a substantially planar front section, which has air inlet louvers formed therein, an air outlet opening formed therein, and an opening configured to receive the units control panel when mounted on the air conditioning unit, the planar front section having a top wall, a bottom wall, and left and right-hand side walls, each of said walls extending rearwardly of the front section and cooperating with one another to define a skirt element integrally formed with and extending rearwardly from the planar front section, wherein the improvement comprises:

forming an elongated recess in said planar front section;

one or more inserts, each of which is configured to be received in said recess, each of said inserts having a distinguishing ornamental configuration thereon, which is different from the distinguishing ornamental configuration of any other of said inserts;

means for retaining each of said inserts in said notch.

2. The apparatus of claim 1 wherein said recess comprises an L-shaped notch formed in at least one of said walls and in the section of said planar front section adjacent thereto.

3. The apparatus of claim 2 wherein said notch is in said bottom wall and extends substantially the full width of said grill; and wherein each of said one or more inserts has a bottom wall, which is configured to be coplanar with said bottom wall of said grill when said insert is installed into said notch, and a front wall, which is provided with said distinguishing ornamental configuration.

4. The apparatus of claim 3 wherein said L-shaped notch includes an elongated front wall lying in a plane substantially parallel to said planar front section and spaced rearwardly therefrom; and a top wall extending outwardly from a top edge of said front wall in perpendicular relationship thereto; further wherein each of said inserts has a top wall extending rearwardly from the top of said front wall, said top wall having at least one alignment and latching configurations extending upwardly therefrom; and said top wall of said notch having openings formed therein for receiving each of said alignment and latching configurations carried by said top wall of said inserts in operative engagement therewith.

5. The apparatus of claim 4 wherein said front wall of said L-shaped notch comprises at least two alignment and latching configurations extending outwardly from the lower end thereof; and wherein said bottom wall of each of said inserts is provided with latch receiving openings therein configured to be engaged by said alignment and latching configurations on said front wall;

whereby upon engagement of said alignment and latching means on said top wall of said insert with said mating openings in said top wall of said notch, and operative engagement between said alignment and latching configurations on said front wall of said notch with said openings in said bottom wall of said insert, said insert is substantially rigidly and permanently attached to said front grill.

* * * * *